United States Patent [19]

Keddie

[11] Patent Number: 4,458,963

[45] Date of Patent: Jul. 10, 1984

[54] TOOL CADDY STOOL

[75] Inventor: Burton G. Keddie, Elm Grove, Wis.

[73] Assignee: Hempe Manufacturing Co., New Berlin, Wis.

[21] Appl. No.: 412,344

[22] Filed: Aug. 27, 1982

[51] Int. Cl.[3] ..... A47B 83/00

[52] U.S. Cl. ..... 312/237; 312/DIG. 33

[58] Field of Search ..... 312/237, DIG. 33; 403/331; 52/236.9, 36; 206/349, 372, 373; 248/205 R

[56] References Cited

U.S. PATENT DOCUMENTS

| | | | |
|---|---|---|---|
| 1,629,213 | 5/1927 | Hughes | 312/DIG. 33 |
| 4,116,332 | 9/1978 | Hartley | 206/361 X |
| 4,240,684 | 12/1980 | Henning | 312/DIG. 33 |
| 4,303,158 | 12/1981 | Perkins | 312/DIG. 33 |
| 4,340,985 | 7/1982 | Potter | 312/DIG. 33 |
| 4,366,998 | 1/1983 | Kaiser | 312/DIG. 33 |

*Primary Examiner*—William E. Lyddane
*Assistant Examiner*—Joseph Falk
*Attorney, Agent, or Firm*—Fuller, House & Hohenfeldt

[57] ABSTRACT

A tool caddy and stool resembling a hollow truncated pyramid that has a rectangular base which is longer than it is wide and a platform top constituting the truncated end. The platform is supported from columns extending from the base and inclined similarly to the sides of a pyramid. The base has a floor which is compartmented for storing items. A shelf or reel for storing an extension cord is removably supported in the caddy. The platform has holes for passing a hand through for carrying the caddy.

1 Claim, 3 Drawing Figures

TOOL CADDY STOOL

BACKGROUND OF THE INVENTION

The invention disclosed herein is a device for storing and carrying tools and other hardware and for use as a stand or a seat.

It is almost certain, if not certain, that most mechanics, especially home handymen who contemplate doing repair, maintenance or construction work on objects in the home or other sites discover that the project requires some tools or hardware other than what they were able to carry at one time to the workplace. The traditional and probably the only suitable response to this situation is to make several trips back to a tool and hardware storage place such as the garage or basement or the truck parked on the street to get those items which were unexpectedly needed. That such conduct or misconduct causes the worker to become fatigued needs no elucidation for anyone who has probably inadvisedly decided to reduce expense by executing his or her own home repair and maintenance projects.

Furthermore, as most home mechanics have discovered, the site of the repair or maintenance activity is never situated at a level at which it is comfortable to do the work. Sometimes the site is low so squatting to work on it seems desirable. In these cases, when after a while the worker decides to stand upright, his knees inform him that squatting for a long time was indeed undesirable. So the worker goes limpingly out on another trip to obtain a box or a stool to sit on if perchance one can be found.

Other job sites that are not too low for comfortable working exhibit a statistical improbability but reality for being situated too high for being reached by simply standing on the floor. Some times the work site is situated just high enough for the worker to be enticed into trying to do the task with his or her arms extended upwardly for a long time. Under this condition it is almost certainly not uncommon for the worker to experience a tingling or prickly sensation or numbness in the arms and hands which a physician might characterize as ischemia while the worker uses other terminology not found in medical texts or even dictionaries to describe it. This is another occasion where an unplanned trip out or back to get a stool or box or a short ladder to stand on is called for.

SUMMARY OF THE INVENTION

The invention is a product designed for mitigating the problems and unpleasantness recounted above.

In particular, the invention is a tool caddy that is structured for sitting on it, for standing on it, for storing and carrying tools and other hardware with it and for keeping tools and hardware within easy reach during performance of a repair, maintenance or construction task. For the sake of convenience, the invention will be called a tool caddy herein. The tool caddy is distinguished by its stability when it is used as something to stand on. It has a height that makes it comfortable to sit on. It allows for orderly arrangement and, hence, quick and easy access and restoration of articles that it carries. And most importantly, it increases the probability that the worker will bring all the tools and hardware necessary to do most tasks to the job site in a single trip.

In general terms, the new tool caddy comprises and oblong truncated pyramid. The pyramid is basically hollow. There are openings in its sides and ends for allowing access to its interior. The upwardly and inwardly angulated corners of the pyramid serve as support columns and are boundaries for the sides of the openings. The columns converge inwardly and upwardly from the pyramid base and their top ends are spanned by a platform on which the user may stand or sit. The interior of the base has a floor and is compartmented to provide open-topped chambers that accommodate tools, for instance, and removable drawers or boxes in which small items such as nuts, bolts and screws are contained. A shelf serves as a rest for winding an extension cord on it and is removable from and insertable into the hollow interior of the caddy. A flat web or bar extends across an end opening of the pyramid and is provided with suitable holes for accommodating tools such as pliers and screwdrivers.

A more detailed description of a preferred embodiment of the tool caddy will now be set forth in reference to the drawings.

DESCRIPTION OF A PREFERRED EMBODIMENT

Figure 1:
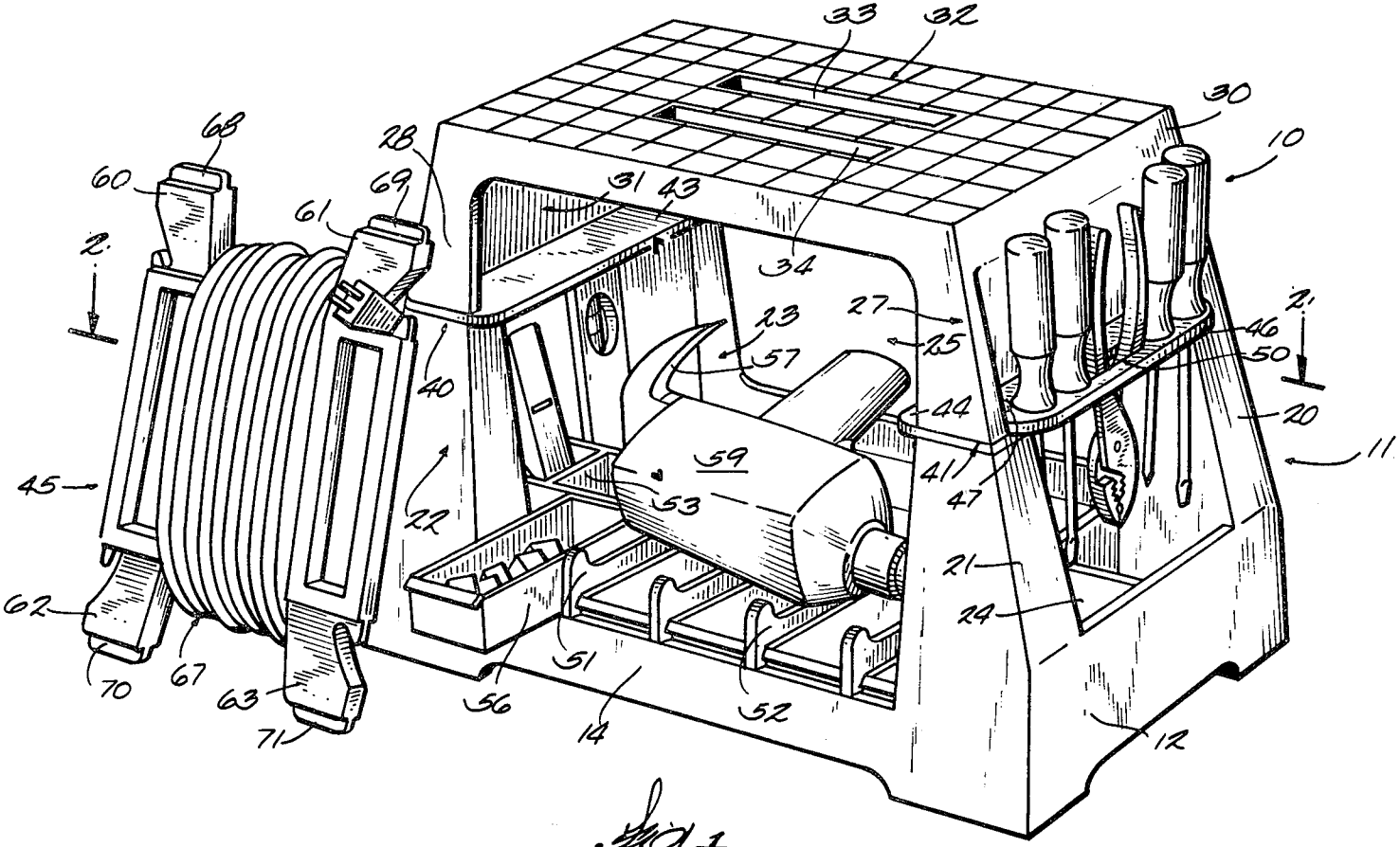
FIG. 1 is a perspective view of the new tool caddy loaded with typical hardware which it is adapted for storing and transporting, said view also showing the extension cord shelf leaning against the caddy.

The tool caddy depicted in FIG. 1 is composed primarily of two major translucent molded plastic sections, an upper section to which the arrowheaded lead line from numeral 10 is pointing and a lower section to which the arrowheaded lead line from numeral 11 is pointing. The overall shape of the caddy is basically that of a truncated pyramid which is longer than it is wide. The lower section has a base portion composed of opposite and similar end walls extending in the width direction or laterally and marked 12 and 13, the latter of which is visible from the top in FIG. 2. The base portion also has opposite and similar side walls extending in the length direction or longitudinally and they are marked 14 and 15. The base portion has a floor spanning across its bottom, some parts of which are slanted as at 18 in FIG. 3 and some of which are horizontal as at 19.

Four tapering columns 20–23 are molded integrally with the base and extend upwardly from it. The taper on the outsides of the columns contributes to the general pyramidical shape of the caddy. As can be seen, the lateral spacing of columns 20 and 21 and their counterparts 22 and 23 creates an opening such as the one marked 24 in FIG. 1 to allow manual and visual access to the interior of the tool caddy from its end. Longitudinally spaced apart columns 21 and 22, for example, and their counterparts 20 and 23 create openings such as the one marked 25 in the long sides of the caddy for clear visual and manual access to the interior of the caddy.

The upper section 10 of the caddy comprises four web-like columns three of which 26, 27 and 28 are visible in FIG. 1. The columns are spanned by integrally molded end walls 30 and 31. The upper columns are tapered for being confluent with the four upstanding lower columns to preserve the pyramid shape of the caddy. A platform 32 that may be sat or stood on by the user spans between the upper columns. Platform 32 has parallel hand holes 33 and 34 in it and the section of the platform between the holes provides something to grip for carrying the tool caddy.

As can be seen in all of the FIGURES, laterally extending flat spacers 40 and 41 are interposed between the upper four and lower four columns and the upper and lower major sections 10 and 11. The inside edges 43 and 44 of spacers 40 and 41, as can be seen best in FIGS. 1 and 3, protrude into the interior of the nominally hollow pyramid and the edges 43 and 44 serve as ledges for supporting a generally planar shelf that serves as an extension cord reel and is identified by the numeral 45. The reel will be discussed more fully later.

Figure 2:
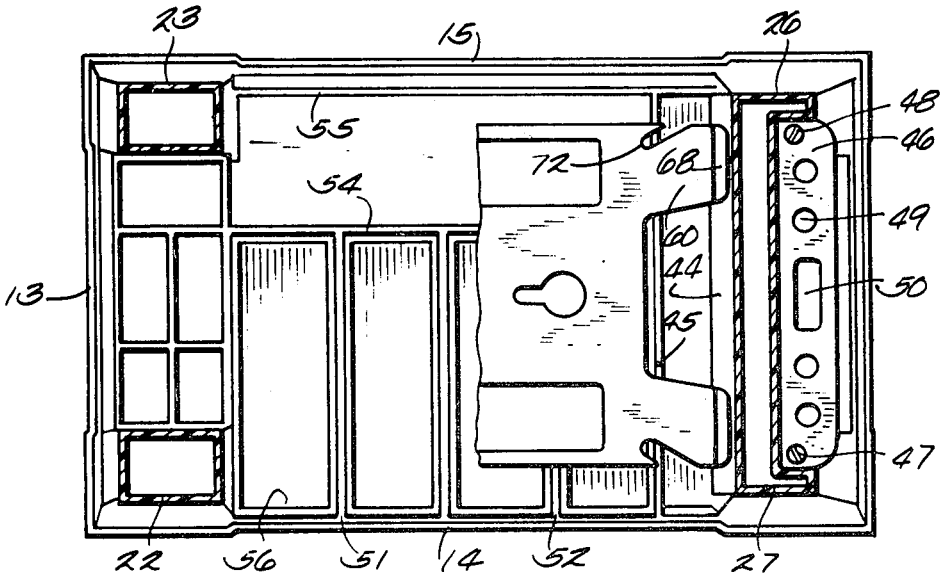
FIG. 2 has the hardware shown in FIG. 1 removed and is a partially sectional and partially fragmentary plan view of the interior of the caddy, that is, looking downwardly into it from above the horizontal planes defined by the offset line 2—2 in FIG. 1.

On the outside ends of the tool caddy and superimposed on spacers 40 and 41 there are some flat horizontal webs or shelves such as the one marked 46 which is visible in FIGS. 1 and 2. Web or shelf 46, for example, is molded integrally with top caddy section 10 and extends horizontally from it. As can be seen best in FIG. 3, self-tapping screws such as the one marked 48 pass through clearance holes in shelf 46 and spacer 41 and thread into the tops of the columns such as column 20 to hold the upper and lower caddy sections 10 and 11 together. The matching screw is marked 47. Shelf 46 has a plurality of holes such as those marked 49 and 50 in FIG. 2. As can be inferred from FIG. 1, these holes serve as sockets for retaining tools such as a variety of screwdrivers, an awl and a pair of pliers. These more frequently used tools are easily reachable by a worker standing or sitting on platform 32.

Figure 3:
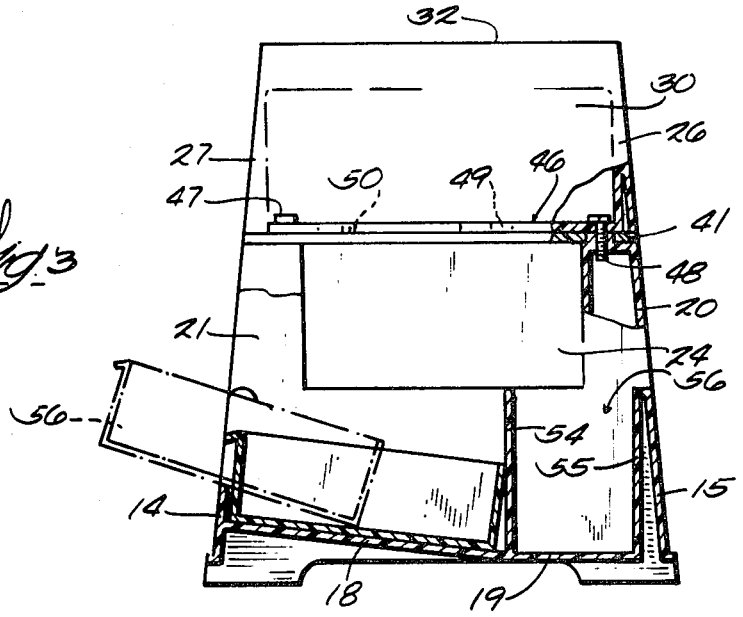
FIG. 3 is an end view of the tool caddy with parts broken away to shown in cross section some of the walls or dividers that define storage compartments.

A plurality of walls projecting integrally and upwardly from the interior floor of the caddy divide the floor into compartments for keeping hardware items and tools in place. For example, parallel compartment walls including those marked 51 and 52 and a wall 53 are readily visible in FIG. 1. Walls 54 and 55 can be seen in FIG. 3. Longitudinally extending walls 54 and 55 together with the floor section 19 in FIG. 3 define a long open-topped compartment 56 for storing a hammer 57, for example, as shown in FIG. 1. Laterally extending walls or dividers such as the one marked 51 in conjunction with wall 54 and base wall 14 form compartments in which drawers such as the one marked 56 may be contained. These drawers rest on the slanted floor section 18 as shown in FIG. 3. A drawer 56 partially withdrawn is shown in phantom lines in FIG. 3 and in solid lines in FIG. 1. Note in FIG. 3 that when a drawer is partially withdrawn it has an inclination to return to home position because of the slanted floor 18 rather than to fall out unless it is withdrawn beyond its balance point. Small items such as nuts, bolts, screws and nails may be kept in the drawers. Small tools such as the spirit level 58 can be stored in other compartments, for example. An electric hand drill 59 may be laid over the top of the compartments and drawers as suggested in FIG. 1.

The extension cord reel 45 is shown withdrawn from the interior of the tool caddy in FIG. 1. The reel is basically a planar body molded of plastic and having four longitudinal projections 60, 61, 62 and 63. These projections act as retainers for an extension cord 67 that is wrapped around the reel. The projections have longitudinally extending lips 68–71. The reel can be inserted through the large side opening in the caddy for storage therein. The reel is held in a stable horizontal position by tongues 68 and 69 that rest on edge 44 of flat spacer 41 and tongues 70 and 71 that rest on the edge 43 of flat spacer 40. The tongues, being thinner than the projections from which they extend form shoulders with the projections that prevent longitudinal sliding of the reel when the tongues are on the ledges 43 and 44 as is the case when the reel is in storage.

As can be seen in FIG. 2, the extension cord reel 45 has a notch 72 for gripping the free end of the extension cord and holding it.

Although an embodiment of the multiple utility tool caddy has been described in considerable detail, such description is intended to be illustrative rather than limiting, for the invention may be variously embodied and is to be limited only by interpretation of the claims which follow.

I claim:

1. A multiple utility caddy useable for carrying and storing objects such as hardware and tools and for serving as a stool, comprising:

a generally rectangular base and a platform supported nominally in parallelism and in spaced relationship in respect to the base, the longitudinal and lateral dimensions of the platform being less than the corresponding longitudinal and lateral dimensions of the base, column means extending, respectively, from the corners of the base and to the platform with which they are joined for supporting the platform, said column means being tapered inwardly and upwardly from the longer base to the platform to give the caddy the general characteristics of a truncated hollow rectangular pyramid in conjunction with the platform and base, the spaced apart column means at corresponding corners on at least one side of said base in conjunction with said spaced apart platform and base defining an opening providing access to the interior of the caddy, and a floor spanning across the interior of the base and means for dividing the space above the floor into compartments that are accessible through said opening and are for storing objects, each of said column means comprising two sections, a lower one which extends up from the base as aforesaid and an upper one of which extends downwardly from the platform, means for connecting said column sections together, a shelf extending laterally between corresponding column means on the outside of said caddy and fastened to each of the column means, said shelf having holes for accommodating tools and the like, spacer members interposed between the upper and lower sections of corresponding laterally spaced apart column means at respectively opposite ends of the caddy, said spacer members providing ledges projecting longitudinally toward each other interiorly of the caddy and vertically spaced from the platform, a shelf constituting a reel for winding an extension cord thereon, said shelf having two laterally spaced apart projections at each end for accommodating the windings of a cord between them, said projections having tongues formed on them for overhanging said ledges and shoulders formed adjacent the tongues for abutting the ledges and for releasably securing said shelf in position on said ledges.

* * * * *